US007711090B2

(12) United States Patent
Schweizer et al.

(10) Patent No.: US 7,711,090 B2
(45) Date of Patent: May 4, 2010

(54) PRODUCTION OF X-RAY IMAGES CONTAINING A REDUCED PROPORTION OF SCATTERED RADIATION

(75) Inventors: Bernd Schweizer, Herzogenrath (DE); Michael Overdick, Langerwehe (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 12/296,309

(22) PCT Filed: Mar. 28, 2007

(86) PCT No.: PCT/IB2007/051095

§ 371 (c)(1), (2), (4) Date: Oct. 7, 2008

(87) PCT Pub. No.: WO2007/116333

PCT Pub. Date: Oct. 18, 2007

(65) Prior Publication Data

US 2009/0046829 A1 Feb. 19, 2009

(30) Foreign Application Priority Data

Apr. 11, 2006 (EP) ..... 06112458

(51) Int. Cl.
*H05G 1/64* (2006.01)

(52) U.S. Cl. ..... 378/98.12; 378/98.4; 378/98.8

(58) Field of Classification Search ..... 378/7, 378/19, 98.11, 98.12, 207, 62, 98.4, 98.8
See application file for complete search history.

(56) References Cited

U.S. PATENT DOCUMENTS

| | | | | |
|---|---|---|---|---|
| 3,699,340 | A | 10/1972 | Hick et al. | |
| 4,529,882 | A | 7/1985 | Lee | |
| 4,963,746 | A | 10/1990 | Morgan et al. | |
| 5,548,123 | A | 8/1996 | Perez-Mendez et al. | |
| 5,629,968 | A * | 5/1997 | Trauernicht | 378/98.8 |
| 6,052,433 | A | 4/2000 | Chao | |
| 6,134,297 | A | 10/2000 | Chao | |
| 2004/0228442 | A1 | 11/2004 | Sakaguchi et al. | |
| 2005/0161609 | A1 | 7/2005 | Heismann et al. | |

FOREIGN PATENT DOCUMENTS

| | | | |
|---|---|---|---|
| EP | 0184247 | A2 | 6/1986 |
| EP | 0782375 | A1 | 7/1997 |
| JP | 06169912 | A | 6/1994 |
| WO | 0135122 | A1 | 5/2001 |

* cited by examiner

*Primary Examiner*—Courtney Thomas

(57) ABSTRACT

The invention relates to a method, to an X-ray apparatus for performing the method and to a detector arrangement intended for the latter, for producing X-ray images containing a reduced proportion of scattered radiation. The X-ray radiation is detected in this case by a detector arrangement comprising two X-ray detectors, there being provided in the first X-ray detector openings through which the second X-ray detector is able to detect scattered radiation and primary radiation by separate detector elements. The signals given by the second X-ray detector are used to determine the proportion of scattered radiation that is contained in the image produced by the first X-ray detector and to largely free the first image of the proportion of scattered radiation.

20 Claims, 3 Drawing Sheets

PRODUCTION OF X-RAY IMAGES CONTAINING A REDUCED PROPORTION OF SCATTERED RADIATION

The invention relates to a method of producing X-ray images containing a reduced proportion of scattered radiation, to an X-ray apparatus for performing this method and to a detector arrangement intended for such an X-ray apparatus.

It is known that the scattered radiation that is produced in a subject being examined has an adverse effect on the quality of an X-ray picture that is taken of the subject being examined. Therefore, in many examination processes, Bucky grids that comprise a plurality of strips made of a material that absorbs X-ray radiation are arranged behind the subject being examined. The strips are aligned with the focus of the source of X-ray radiation, and the X-ray radiation that is emitted by the source and is not scattered by the subject being examined (the primary radiation) can thus make its way between the strips and through to the receiving or recording medium, e.g. a film. Of the scattered radiation that is produced in the subject being examined on the other hand, a proportion of greater or lesser size is absorbed by the strips, which means that the resulting X-ray image contains a reduced proportion of scattered radiation as compared with an X-ray image taken without a Bucky grid.

However, to offset this advantage there is the disadvantage that the proportion of the primary radiation that propagates in the plane of the strips is also suppressed. The result of this is either that the exposure of the patient to radiation has to be increased to compensate for the loss of dosage caused by the Bucky grid, or else that a poorer signal-to-noise ratio has to be accepted. In various applications, e.g. in mammography, the benefit of a Bucky grid is therefore contested.

Known from U.S. Pat. No. 6,134,297 is a solution in which the proportion of noise in X-ray images is reduced without the use of a Bucky grid. In this method, what is used as a receiving medium is a detector arrangement that comprises two (digital) X-ray detectors that are arranged one behind the other in the direction in which the X-ray radiation travels. By the use of suitable means arranged downstream of the first X-ray detector, it is arranged in this case that certain detector elements in the second X-ray detector can be struck either substantially only by primary radiation or substantially only by scattered radiation. In one of these two alternatives, a collimator, that is provided with bores uniformly distributed in space that are aligned with the focus of the source of X-ray radiation, is arranged between the two X-ray detectors. Consequently, the second X-ray detector can only be struck by primary radiation in the region of the bores, which means that, at the second detector, what is produced from the signals from the detector elements struck by the radiation is a low-resolution image of primary radiation.

From this image, it is possible to calculate a low-resolution image of primary radiation for the first detector, which is subtracted from a low-resolution X-ray image obtained from the X-ray image from the first X-ray detector. Because the image obtained from the first X-ray detector is determined by primary radiation and scattered radiation, whereas the image obtained from the second X-ray detector is affected only by the primary radiation, the difference that is formed in this way corresponds substantially to the scattered radiation in the first image. This image of scattered radiation is subtracted from the high-resolution image conveyed by the first detector, the intention being for this to result in an X-ray image containing a reduction proportion of scattered radiation.

In the conversion of the low-resolution image of primary radiation obtained from the second X-ray detector into a low-resolution image of primary radiation for the first X-ray detector, the absorption of the primary radiation by the subject being examined, which varies with geographical position, has to be taken into account, which means that only a rough estimate can be made of the proportions of scattered radiation and primary radiation at the first detector.

It is an object of the present invention to specify an improved method of producing X-ray images containing a reduced proportion of scattered radiation. This object is achieved in accordance with the invention by a method of producing X-ray images containing a reduced proportion of scattered radiation having the following steps:

a. detection of the X-ray radiation by a first X-ray detector, for the production of a first image, b. detection of the X-ray radiation that passes through openings in the first X-ray detector by a second X-ray detector arranged at a distance from the first X-ray detector, c. combining of the signals from the two X-ray detectors to produce an X-ray image containing a proportion of scattered radiation that is reduced in comparison with the first image.

In the case of the invention, allowance is made for the fact that, when the input dosage is low, an X-ray detector can only give an X-ray image containing a low proportion of noise when it absorbs the X-ray radiation as completely as possible. What the openings that are provided in accordance with the invention in the first X-ray detector therefore do is allow the X-ray radiation to reach the second X-ray detector virtually unattenuated in the region of these openings. If the distance between the two X-ray detectors is a plurality of times greater than the diameter of the openings, the openings cause the primary and scattered radiation to be separated at the point at which the second detector is situated. Those detector elements that are connected, through the opening, to the focus of the X-ray radiation by a straight line receive primary radiation, whereas the detector elements surrounding them are struck by scattered radiation. The detection of the X-ray radiation in virtually unattenuated form and the separation of the primary radiation and scattered radiation make it substantially easier for the scattered radiation to be reduced.

What are called "X-ray detectors" in connection with the invention are means able to supply electrical signals that are dependent on geographical position and on intensity; as a rule they comprise a plurality of cells or detector elements arranged in the form of a matrix, each of which produces an electrical signal dependent on the particular intensity of the X-ray radiation. The term "opening" in this case means that the detector layer that, in an X-ray detector, converts the X-ray quanta into light or an electrical signal (and therefore absorbs or in other words attenuates the X-ray radiation), is interrupted in the region of the openings. This interruption may, however, be filled with material. All that is essential is that the attenuation of the X-ray radiation by this material must be small compared with the attenuation that is caused to the X-ray radiation by the said detector layer.

In principle, it would be possible for the scattered radiation to be determined by a method similar to that described in U.S. Pat. No. 6,134,297 in which the difference was found between low-resolution images of primary radiation from the first and second X-ray detectors. What is more reliable, however, is the embodiment described in claim 2, in which use is made of the (separately) measured scattered radiation.

The openings in the first X-ray detector produce gaps in the X-ray image produced by the latter. These gaps in the image could, in principle, be filled by interpolation from the image signals from detector elements in the neighborhood of the openings. The said gaps can, however, be filled in a more advantageous way by the embodiment of the method that is described in claim 3.

An X-ray apparatus for carrying out the method claimed in claim 1 is provided with a. a source of X-ray radiation, b. a detector arrangement for detecting the X-ray radiation emitted by the source of X-ray radiation, the detector arrangement comprising a first and a second X-ray detector that are arranged at a distance from one another, the first X-ray detector being provided with openings through which individual detector elements of the second X-ray detector are struck by X-ray radiation, and is provided with c. means for combining the signals supplied by the X-ray detectors to produce an X-ray image containing a reduced proportion of scattered radiation.

As a rule, an X-ray detector does not absorb the whole of the X-ray radiation that is incident on it but only a large part thereof. This could result in detector elements of the second X-ray detector being struck by X-ray radiation that had been attenuated by the first X-ray detector. This could have a deleterious effect on the quality of the X-ray image produced by combining the signals from the two X-ray detectors. This deleterious effect is largely prevented by the embodiment specified in claim 5.

If the openings were cylindrical or if they were of constant cross-section in their longitudinal direction, then the top or bottom edge of the openings might attenuate the scattered radiation in particular. In the case of the embodiment specified in claim 6 on the other hand, the scattered radiation is able to pass through the openings largely unattenuated.

It is known that an X-ray detector may be assembled from a plurality of smaller sub-detectors (by what is called tiling). These sub-detectors have to be arranged in such a way that there are no gaps in the radiation-sensitive detecting areas so assembled, which is something that is difficult to achieve in practice. However, in the case of the embodiment of the invention that is specified in claim 7, gaps of this kind are permitted, the image that is produced by the first X-ray detector being supplemented, in the region of the openings in slit form, by signals from the detector elements that are struck by primary radiation in the second X-ray detector.

However, the openings in slit form that arise in this way cause the detector elements belonging to the second X-ray detector that are situated beneath them to be struck not only by primary radiation but also by scattered radiation that travels in a plane containing the focus of the source of X-ray radiation and the opening in slit form. In the case of the embodiment specified in claim 8, however, this scattered radiation is suppressed.

Claim 9 describes a detector arrangement that is suitable for the X-ray apparatus according to the invention. The detecting behavior of the detector elements adjacent the openings can be acted on by means of the openings in this case. In the case of an X-ray detector having a layer of scintillation crystals to detect the X-ray radiation, detecting behavior that is largely unaffected by the opening can be obtained in the manner claimed in claim 10. The light-conducting substance that is provided in the opening in this case absorbs virtually none of the X-ray radiation passing through the opening.

Claims 11-13 relate to advantageous embodiments of the second X-ray detector (or its detector elements) as compared with the first X-ray detector.

These and other aspects of the invention are apparent from and will be elucidated with reference to the embodiments described hereinafter.

Figure 1:
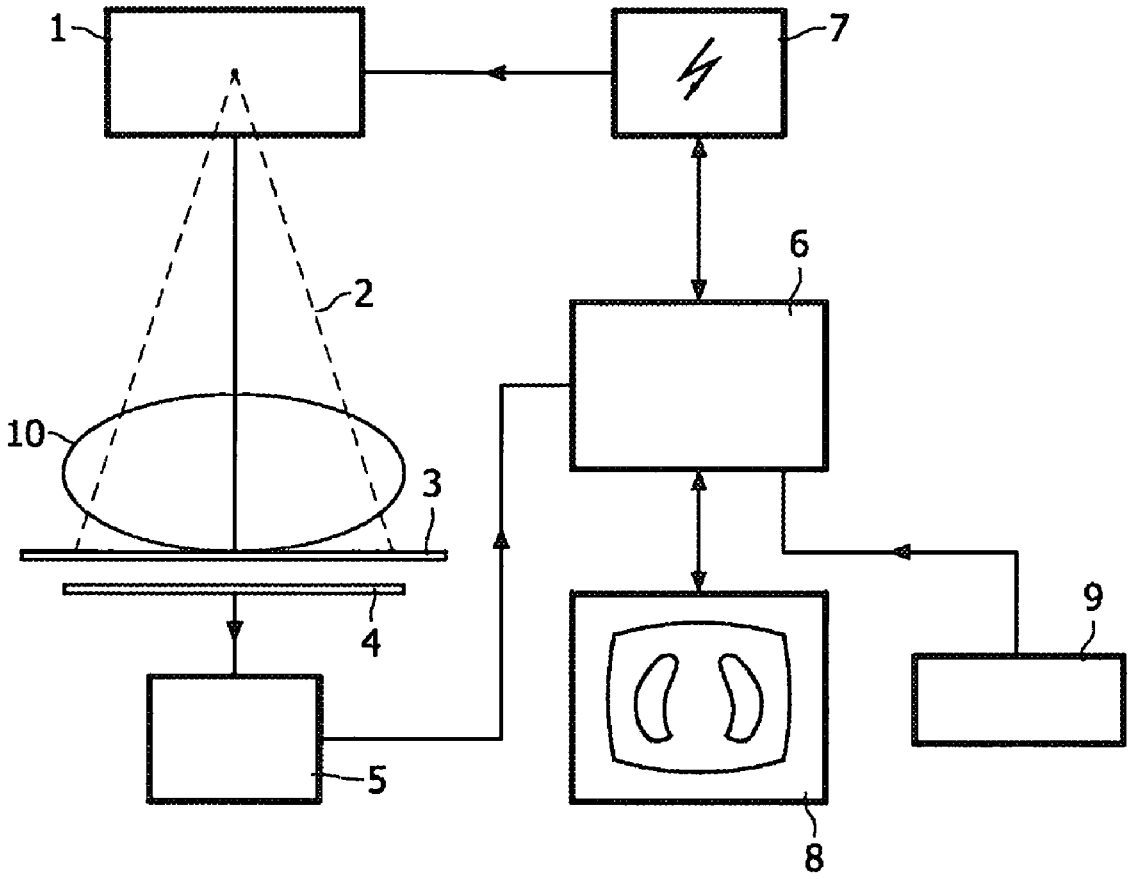
FIG. 1 shows an X-ray apparatus according to the invention.

In FIG. 1, reference numeral 1 denotes a source of X-ray radiation that emits a bundle of rays 2 that passes through a patient 10 who is lying on a patient presentation table symbolized by a table plate 3. Below the table plate 3 is situated a detector arrangement that converts the incident X-ray radiation into electrical signals as a function of geographical position. The signals produced by the detector arrangement 4 are digitized by a control unit 5 and are fed to a workstation 6, in which image processing is performed on the one hand but on the other hand control is also exerted on an X-ray generator 7, to which the source 1 of X-ray radiation is connected. The workstation cooperates with a monitor 8 on which an X-ray image can be reproduced. Also provided is an input unit 9 with which the user can enter control commands.

Figure 2:
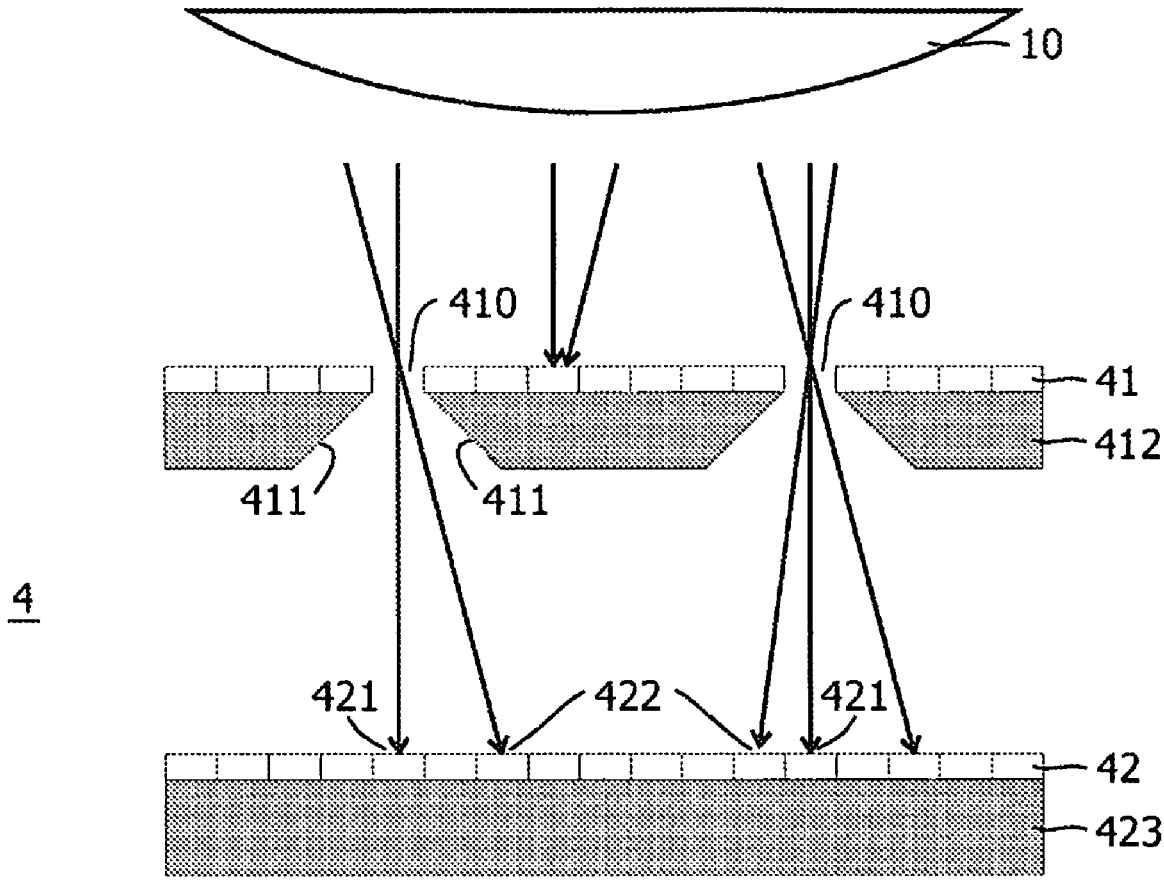
FIG. 2 shows the detector arrangement used in this X-ray apparatus.

FIG. 2 is a cross-section showing a detail of the detector arrangement 4, and part of the subject 10 is also shown to make it easier for the orientation to be seen. The detector arrangement 4 comprises two X-ray detectors 41 and 42 that are arranged at a distance from one another. The X-ray detector 41, which is situated closer to the source 1 of X-ray radiation and the subject 10 being examined, is provided with a plurality of openings 410 through which X-ray radiation is able to reach the second X-ray detector 42. The openings 410 are preferably spaced at equal distances from one another—in the horizontal direction and perpendicularly to the plane in which FIG. 2 is drawn.

From the subject 10 emerges primary radiation that, in the detail view shown in FIG. 2, travels perpendicularly, and scattered radiation that arises due to scattering processes within the subject and that generally travels at an angle to the perpendicular. Each detector element of the first X-ray detector can be struck both by primary radiation and also by scattered radiation. Of the detector elements of the second X-ray detector 42 on the other hand, it is virtually only the detector elements 421 that are struck by primary radiation and only the detector elements 422 that are struck by scattered radiation. The straight lines connecting the focus of the source 1 of X-ray radiation and the detector elements 421 pass through the openings 410, whereas the straight lines connecting the detector elements 422 and the focus of the source of X-ray radiation extend outside the openings and intersect the X-ray detector 41.

The first X-ray detector 41 is provided on its rear side with a layer 412 of a material that is highly absorbent of X-ray radiation—e.g. lead or the like. What is achieved in this way is that X-ray radiation can reach the second X-ray detector 42 only through the openings 410 and the measured values given by the detector elements 421 and 422 for the primary radiation and the scattered radiation respectively are not falsified by X-ray radiation that strikes the second X-ray detector by traveling through the first X-ray detector itself. The rear side of the second X-ray detector too may be provided with a layer 423 of the kind mentioned.

If the layer 412 were to extend horizontally even in the region of the openings 410, some of the scattered radiation would be attenuated or absorbed by the bottom edge of the said layer. To prevent this from happening, it is useful for the layer 412 to be beveled in the region of the openings, thus producing in that region a conical widening 411 which opens out towards the second X-ray detector 42. Basically, the layer that is sensitive to X-ray radiation and is adjacent the source of X-ray radiation could also be beveled in this way (which would produce a conical widening facing towards the source of X-ray radiation), but this would have an adverse effect on the sensitivity of the detector elements in the region of the widening.

For the scattered radiation and the primary radiation to be satisfactorily separated from one another at the entry face of the second X-ray detector 42, the distance between the openings and the second detector should be large in comparison with the side-to-side dimensions of the opening, being such for example as 5 to 10 times as large. The larger the distance as compared with the latter dimensions, the better is the separation in space between the primary radiation and the scattered radiation. However, an upper limit is set to the distance between the second detector and the plane of the openings by the fact that the conical bundles of rays of scattered radiation must not overlap at the entry face of the second X-ray detector.

The dimensions of the openings should be sufficiently large for even scattered radiation traveling obliquely to the face of the detector to be able to make its way to the second detector. If the detector is approx. 1 mm thick, this requirement is met by opening dimensions of between 0.5 and 1 mm. In the case of an X-ray detector for radiography or fluoroscopy, this is equal to a multiple of the dimensions of a single detector element. When the application is to computer tomography, for which the invention is likewise suitable, this is approximately equal to the dimensions of a detector element.

As FIG. 1 shows, only the so-called central ray extends perpendicularly to the entry faces of the X-ray detectors. The rays in the beam of rays 2 that are situated further towards the outside thus pass through the openings 410 obliquely. What this means, for example, is that, in the region where this occurs, those detector elements of the second detector that are situated perpendicularly below an opening no longer detect the primary radiation but the scattered radiation, and that the primary radiation is detected by one or more detector elements situated further towards the outside. Account can be taken of this fact in a variety of ways:

If the effective area of the detector elements of the second X-ray detector is larger than the area of the detector elements of the first X-ray detector by the same amount as the distance between the second X-ray detector and the focus of the source of X-ray radiation is larger than the corresponding distance in the case of the first detector, then a 1:1 correspondence is obtained between the openings (i.e. the detector elements that are missing in the region of the opening) and the detector elements (421) in the second X-ray detector that receive the primary radiation.

On the other hand, the detector elements in the second detector may also be of the same dimensions as, or may even be smaller than, the detector elements in the first detector. Because the reception geometry is known, it can be stated, for each individual opening, which detector elements are struck by primary radiation and which detector elements are struck by scattered radiation, the signals from individual detector elements of which only a part is struck by primary radiation being processed, if required, with a suitable weighting factor.

Some of the detector elements in the second X-ray detector are struck neither by primary radiation nor by scattered radiation. These detector elements are therefore superfluous and could be dispensed with. It would, therefore, be enough if the second X-ray detector had a cluster of detector elements in each region that was struck by X-ray radiation behind an opening.

The openings 410 can be formed by ensuring, by suitable means, as part of the production process, that the detector layer that absorbs the X-ray radiation and converts it into light or electrical charges can only form outside the regions intended for the openings; basically however, the detector layer may also be removed from these regions retrospectively. As has already been mentioned, the openings need not be free of matter if it is ensured that the absorption of the X-ray radiation in the region of the openings is negligible compared with the absorption of the X-ray radiation by the first detector. In the case of an X-ray detector having a detector layer formed by a scintillator, the opening could, therefore, be filled by a light-conducting substance, which would result in the opening leaving the characteristics of the detector elements adjacent to it largely unaffected.

As a rule, each detector element comprises a photo-element (e.g. a photodiode), a TFT switch and, if required, further components, which can each be driven and read by controlling and reading conductors respectively. So that these conductors do not have to be run around the openings, it may be useful for the components and conductors concerned to be left in place in the region of the openings. The conductors and components may be so designed that they do not attenuate the X-ray radiation to any appreciable extent.

Figure 3:
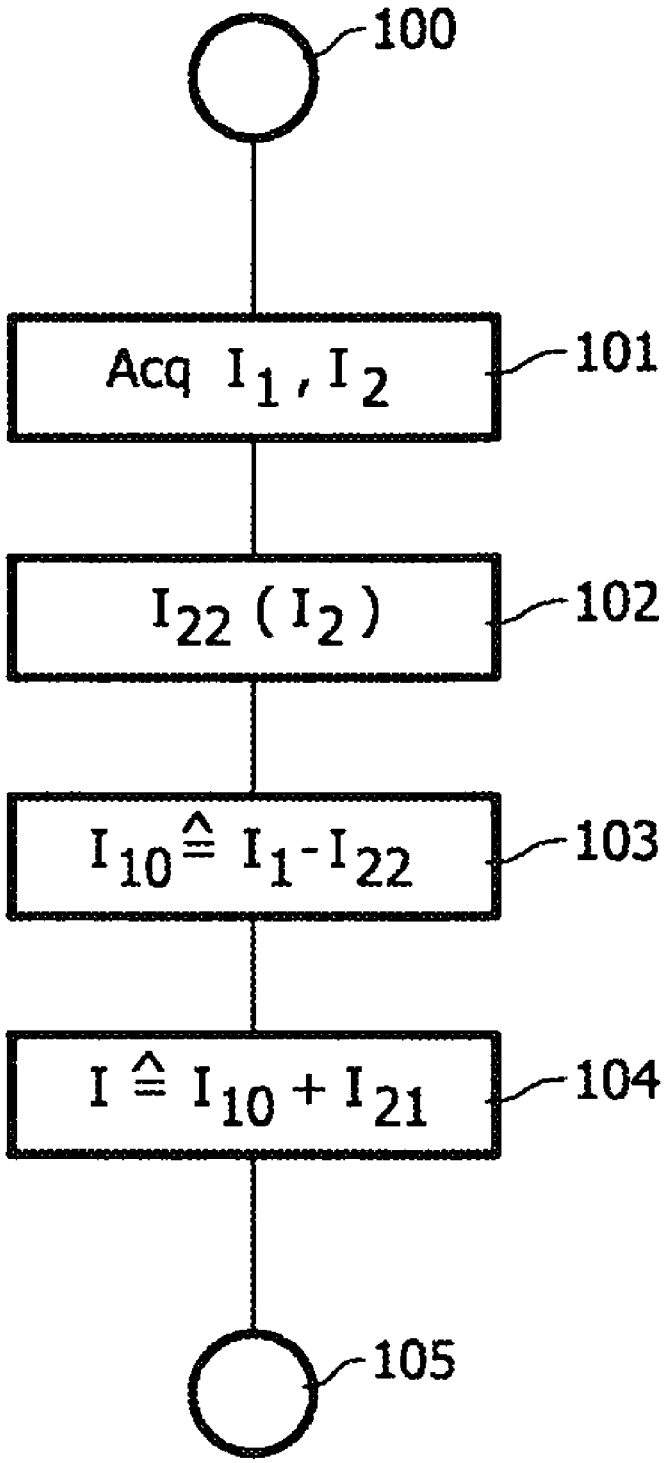
FIG. 3 is a flow chart of the method according to the invention.

In what follows, it will be elucidated by reference to the schematic flow chart shown in FIG. 3 how an X-ray image that has been largely freed of scattered radiation can be produced with the help of the two X-ray detectors. For this purpose, after the initializing in step 100, the source 1 of X-ray radiation is switched on and off in step 101 and the image signals produced by the X-ray detectors 41 and 42 are digitized by the unit 5 and are stored in the workstation 6 in the form of digital image values. These image values are corrected in a known manner to compensate for different sensitivities at each of the two X-ray detectors. The corrections that are required can be determined by means of previous calibrating measurements without a subject in place and/or with a calibrating body having an exactly known absorption curve in place.

From the image values that have been corrected in this way, a first image I1 and a second image I2 can be obtained—with certain provisos: the image I1 produced by the first X-ray detector 41 has scattered radiation superimposed on it, and this image also contains gaps in the region of the openings 410. Also, the image I2 that is obtained from the image values from the second X-ray detector 42 represents only the intensity of the X-rays in the region of the openings 410.

The image values obtained from the detector elements 422 represent the image of scattered radiation that is produced at the entry face of the first X-ray detector, at reference points that are uniformly distributed over the entry face in a way that matches the positions of the openings 410. From it, in step 102, an image I22 is reconstructed that represents, with low spatial resolution, the distribution of the scattered radiation at the entry face of the first X-ray detector. For this purpose, lines and columns that are set to an image value of zero may, for example, be inserted, thus producing, after convolution with a suitable low-pass kernel, the image 122 of low spatial resolution that has a pixel grid that matches that of the image I1. Even more improved determination of the proportion of scattered radiation is also possible because the detectors 422 detect not only the amount of the scattered radiation but also—due to their respective positions in relation to the opening 410—its direction.

Because the distribution of the scattered radiation changes only slightly in space downstream of the subject 10 being examined, the low spatial resolution of the image 122 is enough if a suitable choice is made of the distance between the openings 410. The distance may be greater by a factor of 10-100 than the dimensions of an individual detector element. If the detector has, for example, 2000×2000 detector elements, then 20×20 uniformly distributed openings 410 are enough.

In step 103, the image 122 of scattered radiation is then subtracted, pixel by pixel, from the image I1 given by the first X-ray detector, the difference being set to zero for the pixels that are missing in image I1 due to the openings 410. The resultant image I10 then represents the image from the first detector after being substantially freed of the proportion of scattered radiation, i.e. an image that is determined substantially only by primary radiation.

The gaps in this image that are caused by the opening 410 are filled, in step 104, by the image values 121 that originate from the detector elements 421 of the second detector and that correspond to the primary radiation that passes through the opening 410. The resulting image I is an X-ray image of high spatial resolution containing a largely reduced proportion of scattered radiation. After this, the method comes to an end (block 105).

The method according to the invention can also advantageously be used in the case of X-ray detectors that are assembled from a plurality of sub-detectors. The sub-detectors must be so arranged, in this case, that no gap appears in the entry face that is sensitive to X-ray radiation. This is a problem in practice, which can be made less serious by permitting a gap equal in width to one or more detector elements between adjacent sub-detectors. The view shown in FIG. 2 then also applies to a detector of this kind, although the openings 410 are not circular or square but are in the form of slits perpendicular to the plane in which FIG. 2 is drawn. The gaps that appear in the image from the first X-ray detector in the region of the slits may once again be filled by signals from the detector elements of the second X-ray detector that are situated below the slits and are struck by primary radiation. The sub-detectors may, in addition, also have square or circular openings in this case.

However, in the region of the slits, the detector elements may also be struck by scattered radiation that travels in planes containing the slits. This proportion of scattered radiation, which is already reduced anyway in comparison with an X-ray image produced in a conventional way, can be reduced still further by Bucky-type strips extending perpendicularly to the openings in slit form, which strips extend in planes that intersect the focus of the X-ray detector.

The invention can be applied to pieces of X-ray apparatus by which individual (radiographic) X-ray pictures are produced, particularly in mammography. The invention can, however, also be used in computer tomographs, and particularly in multi-line computer tomographs, in which case each individual view, i.e. each X-ray image that is taken by the individual detector elements with the system comprising the radiant source and the detector arrangement in a given angular position, is processed in the manner that has been described in connection with FIGS. 1 to 3. The invention can also be applied to other X-ray systems with which three-dimensional images representing volumes of space can be produced and finally it can also be applied in X-ray apparatus for transmission irradiation or fluoroscopy using dynamic X-ray detectors.

The invention claimed is:

1. A method of producing X-ray images containing a reduced proportion of scattered radiation, having the following steps:

a. detection of the X-ray radiation by a first X-ray detector, for the production of a first image, b. detection of the X-ray radiation that passes through openings in the first X-ray detector by a second X-ray detector arranged at a distance from the first X-ray detector, c. combining of the signals from the two X-ray detectors to produce an X-ray image containing a proportion of scattered radiation that is reduced in comparison with the first image, wherein the signals from those detector elements in the second X-ray detector that are struck through the openings by scattered radiation but not by primary radiation are used to determine the scattered radiation contained in the first image.

2. A method as claimed in claim 1, wherein the signals from detector elements that are struck, through the openings, by primary radiation are used to fill the gaps in the image caused by the openings in the first X-ray detector.

3. A method as claimed in claim 1, wherein image values obtained by the second X-ray detector represent scattered radiation at reference points which are distributed so as to match positions of the openings in the first X-ray detector.

4. A method as claimed in claim 1, where the first image has scattered radiation superimposed onto it and wherein the first image contains at least one gap in at least one region of the openings.

5. A method as claimed in claim 4, wherein the gaps in the image are filled in by image values that originate from those detector elements of the second X-ray detector that correspond to the primary radiation that passes through the openings.

6. A method as claimed in claim 1, wherein the second X-ray detector detects an amount for the scattered radiation and a direction for the scattered radiation.

7. A method as claimed in claim 1, wherein the combined signals are digitized and corrected to compensate for at least one different radiation sensitivity at each of the two X-ray detectors.

8. A method as claimed in claim 1, wherein the first and second images are three-dimensional images representing a volume.

9. An X-ray apparatus for carrying out the method as claimed in claim 1, having a. a source of X-ray radiation, b. a detector arrangement for detecting the X-ray radiation emitted by the source of X-ray radiation, the detector arrangement comprising a first and a second X-ray detector that are arranged at a distance from one another, the first X-ray detector being provided with openings through which individual detector elements of the second X-ray detector are struck by X-ray radiation, and having c. means for combining the signals supplied by the X-ray detectors to produce an X- ray image containing a reduced proportion of scattered radiation, wherein the signals from those detector elements in the second X-ray detector that are struck through the openings by scattered radiation but not by primary radiation are used to determine the scattered radiation contained in the first image.

10. An X-ray apparatus as claimed in claim 9, wherein, on its side adjacent the second X-ray detector except in the region of the openings the first X-ray detector is provided with a layer of a material that is absorbent of X-ray radiation.

11. An X-ray apparatus as claimed in claim 9, wherein the first X-ray detector is beveled around the openings in a conical shape, thus enabling the scattered radiation to pass through the openings largely unaffected.

12. An X-ray apparatus, in particular as claimed in claim 9, wherein at least the first X-ray detector is assembled from a plurality of sub-detectors that are separated from one another by openings in slit form, the signals from those detector elements of the second X-ray detector that are struck by primary radiation being used to supplement the X-ray image detected by the first X-ray detector.

13. An X-ray apparatus as claimed in claim 12, having Bucky-type strips for suppressing the scattered radiation that is scattered in the longitudinal direction of the openings, which strips are arranged between the two X-ray detectors and extend perpendicularly to the openings.

14. A detector arrangement for an X-ray apparatus as claimed in claim 9, which arrangement comprises two X-ray detectors arranged at a distance from one another, one of which is provided with openings that are uniformly distributed in space.

15. A detector arrangement as claimed in claim 14, wherein at least the X-ray detector that is provided with openings has a scintillation crystal layer, and wherein the openings are filled with a light-conducting substance that is transparent to the X-ray radiation.

16. A detector arrangement as claimed in claim 14, wherein the detector elements of the two X-ray detectors are of the same dimensions.

17. An X-ray detector as claimed in claim 14, wherein the dimensions of the detector elements of the first X-ray detector, which latter is provided with openings, are slightly smaller than the dimensions of the detector elements of the second X-ray detector, in such a way that, when use is in an X-ray apparatus, the dimensions of the detector elements of the second X-ray detector are larger than the dimensions of the detector elements of the first X-ray detector, at least approximately by the same amount as the distance between the second X-ray detector and the focus of the source of X-ray radiation is larger than the corresponding distance in the case of the first detector.

18. An X-ray detector as claimed in claim 14, wherein the second X-ray detector has detector elements only in those regions that can be struck by X-ray radiation through the openings in the first detector.

19. An X-ray apparatus as claimed in claim 9, wherein the first and second X-ray detectors comprise a plurality of sub-detectors.

20. An X-ray apparatus as claimed in claim 19, wherein the plurality of sub-detectors are arranged to comprise openings which have a rectangular, square or circular shape.

* * * * *